US008629809B2

(12) United States Patent
Yamagajo et al.

(10) Patent No.: US 8,629,809 B2
(45) Date of Patent: Jan. 14, 2014

(54) TAG PATCH ANTENNA AND RFID TAG USING TAG PATCH ANTENNA

(75) Inventors: Takashi Yamagajo, Kawasaki (JP); Toru Maniwa, Kawasaki (JP); Manabu Kai, Kawasaki (JP); Yoshiyasu Sugimura, Inagi (JP); Shunji Baba, Kawasaki (JP)

(73) Assignees: Fujitsu Limited, Kawasaki (JP); Fujitsu Frontech Limited, Inagi (JP)

( * ) Notice: Subject to any disclaimer, the term of this patent is extended or adjusted under 35 U.S.C. 154(b) by 1015 days.

(21) Appl. No.: 12/686,105

(22) Filed: Jan. 12, 2010

(65) Prior Publication Data

US 2010/0109874 A1 May 6, 2010

Related U.S. Application Data

(63) Continuation of application No. PCT/JP2007/000854, filed on Aug. 8, 2007.

(51) Int. Cl.
*H01Q 1/38* (2006.01)

(52) U.S. Cl.
USPC ..... 343/700 MS

(58) Field of Classification Search
USPC ..... 343/700 MS, 933, 720, 873, 702, 767; 340/572.7
See application file for complete search history.

(56) References Cited

U.S. PATENT DOCUMENTS

| | | | | |
|---|---|---|---|---|
| 6,100,804 | A * | 8/2000 | Brady et al. | 340/572.7 |
| 6,215,402 | B1 | 4/2001 | Rao Kodukula et al. | |
| 6,392,609 | B2 * | 5/2002 | Nieminen | 343/767 |
| 6,894,624 | B2 | 5/2005 | Kim et al. | |
| 7,508,347 | B2 * | 3/2009 | Sakama et al. | 343/700 MS |
| 7,570,225 | B2 * | 8/2009 | Kai et al. | 343/895 |
| 7,701,350 | B2 * | 4/2010 | Sakama et al. | 340/572.7 |
| 8,120,492 | B2 * | 2/2012 | Scharfeld et al. | 340/572.7 |
| 2002/0050954 | A1 | 5/2002 | Jeong-Kun et al. | |
| 2003/0006901 | A1 | 1/2003 | Kim et al. | |
| 2003/0112192 | A1 * | 6/2003 | King et al. | 343/718 |
| 2004/0008146 | A1 | 1/2004 | Ikegaya et al. | |
| 2005/0134460 | A1 | 6/2005 | Usami | |
| 2005/0200539 | A1 | 9/2005 | Forster et al. | |
| 2006/0163368 | A1 | 7/2006 | Fogg | |
| 2008/0018479 | A1 * | 1/2008 | Hashimoto et al. | 340/572.8 |

FOREIGN PATENT DOCUMENTS

| | | |
|---|---|---|
| CN | 1926718 A | 3/2007 |
| JP | 3030590 | 4/2000 |
| JP | 2001351084 A | 12/2001 |

(Continued)

OTHER PUBLICATIONS

Office Action dated Apr. 26, 2012 received in corresponding Chinese Application No. 200780100109.0.

(Continued)

*Primary Examiner* — Huedung Mancuso
(74) *Attorney, Agent, or Firm* — Smith, Gambrell & Russell, LLP

(57) ABSTRACT

A tag patch antenna includes: a slit formed in the vicinity of an edge of an antenna pattern along a part of the edge; and a feeding point to which a tag LSI is connected and which is formed by cutting an intermediate portion of the part of the edge separated by the slit from a body of the antenna pattern by a width of the slit.

9 Claims, 12 Drawing Sheets

(56) References Cited

FOREIGN PATENT DOCUMENTS

| | | | |
|---|---|---|---|
| JP | 2002111536 | | 4/2002 |
| JP | 2002198723 | | 7/2002 |
| JP | 2004503125 | | 1/2004 |
| JP | 2004220413 | | 8/2004 |
| JP | 2004356895 | | 12/2004 |
| JP | 2005056221 | | 3/2005 |
| JP | 2005149298 | | 6/2005 |
| JP | 2005167813 | | 6/2005 |
| JP | 3690375 | | 8/2005 |
| JP | 2006157905 | | 6/2006 |
| JP | 2006195796 | | 7/2006 |
| JP | 2006295630 | | 10/2006 |
| JP | 2006333403 | | 12/2006 |
| JP | 2007174153 | | 7/2007 |
| JP | 2007180704 | A | 7/2007 |
| KR | 10-0409047 | B1 | 12/2003 |
| WO | 2006114821 | A1 | 11/2006 |

OTHER PUBLICATIONS

Leena Ukkonen, Marijke Schaffrath, Lauri Sydanheimo, and Markku Kivikoshi, "Analysis of Integrated Slot-Type Tag Antennas for Passive UHF RFID,"in IEEE AP-S Int. Symp. pp. 1343-1346, 2006.

Japanese Notice of Rejection Grounds dated Jun. 7, 2012 issued in application No. 2009-526267.

Notification of Preliminary Rejection dated May 18, 2011 (for the corresponding Korean patent application No. 10-2010-7002002.

International Search Report dated Sep. 25, 2007 based on International application No. PCT/JP2007/000854.

Extended European Search Report dated Nov. 24, 2010 received in corresponding European Patent Application No. 07790342.5-1248/2178161 PCT/JP2007000854.

Official Letter dated Nov. 2, 2010 received in corresponding Taiwanese application No. 096129193.

Analysis of Integrated Slot-Type Tag Antennas for Passive UHF RFID pp. 1343-1346 Leena Ukkonen et al. Tampere University of Technology, Institute of Electronics, Rauma Research Unit 2006.

* cited by examiner

TAG PATCH ANTENNA AND RFID TAG USING TAG PATCH ANTENNA

CROSS-REFERENCE TO RELATED APPLICATIONS

This application is a continuation of a PCT application PCT/JP2007/000854 filed on Aug. 8, 2007, the entire contents of which are incorporated herein by reference.

FIELD

The present invention relates to a tag patch antenna, and an RFID (radio frequency identification) tag using the tag patch antenna, and more particularly, to a tag patch antenna in which the communication distance is not deteriorated despite being attached to an object including a liquid or a metal and which has a simple and inexpensive structure, and to an RFID tag using the tag patch antenna.

BACKGROUND

Conventionally, RFID systems where a reader/writer transmits a radio wave of approximately 1 W, a tag side receives the signal and returns information within the tag with a radio wave, and the reader/writer identifies the tag, have been put into practical use.

The tag includes an antenna and an LSI chip connected to the antenna. The tag does not include a power supply within the tag itself, but activates the circuit of the LSI chip by using power induced by resonance with communication waves from a reader/writer, and transmits an ID and the latest updated data within a memory to the reader/writer.

In such an RFID system, a wireless signal of the UHF (Ultra High Frequency) band (865 MHz in EU, 915 MHz in US, and 953 MHz in Japan) is used.

A communication distance of an RFID system using such a UHF band is relatively long, and is expected to be utilized in various fields in the future.

However, if the tag is attached to a metal such as a personal computer, an automobile, a container, a steel desk, etc., or an object including a liquid, such as a polyethylene terephthalate bottle, a human body, etc., the antenna gain of the tag is deteriorated by mirror image effects peculiar to the metal being a good conductor of electricity or the liquid, leading to a significant deterioration in the communication distance of the tag. A solution to this problem has been demanded.

In light of the above described background, various types of tag antennas adaptable to metals or liquids have been devised so far, and some of them have been commercialized.

For example, Patent Document 1 as such conventional technology describes a configuration for preventing a patch antenna from being affected by an object existing on the side of a ground conductor by arranging the ground conductor in a position opposed to the patch antenna with respect to an interposed dielectric, and by arranging a tag to make the ground conductor contact the object including a liquid or a metal.

However, to implement the configuration described by Patent Document 1, an LSI chip must be connected to the patch antenna and the ground conductor, which are arranged above and under the interposed dielectric. This connection is made using a method of installing a connection wire to go around the side surface of the dielectric, or using a method of forming a penetration hole in the dielectric and of inserting a connection wire into the penetration hole. Both of these methods require cumbersome process steps.

In the meantime, Patent Document 2 as conventional technology which does not require such cumbersome process steps describes a method by which an LSI chip can be connected to a patch antenna with only a process executed on the surface of a dielectric.

However, for the tag antenna described by the above described Patent Document 1 or 2, an expensive material such as a high-frequency substrate, ceramics, etc. is used as a dielectric onto which the tag antenna is pasted. Therefore, further reductions in product price are desired so as to meet growing demand expected in the future. Moreover, the demands for a further increase in the communication distance and a broader band of available frequencies have been increasing.

Patent Document 1: Japanese Laid-open Patent Publication No. 2006-157905 (FIGS. 1-4 and 6-8)

Patent Document 2: U.S. Pat. No. 6,215,402 B1 (FIGS. 3, 4A and 4B)

SUMMARY

An object of the present invention is to provide a tag patch antenna in which the communication distance is not deteriorated despite being attached to an object including a liquid or a metal and which has a simple and inexpensive structure, and an RFID tag using the tag patch antenna.

A tag patch antenna in a first aspect of the present invention includes a slit formed in the vicinity of an edge of an antenna pattern along a part of the edge, and a feeding point to which a tag LSI is connected and which is formed by cutting an intermediate portion of the part of the edge separated by the slit from the body of the antenna pattern by the width of the slit.

In this tag patch antenna, for example, the intermediate portion of the part of the edge is formed to be tilted toward an inner side of the body of the antenna pattern along with the slit, the feeding point is formed to be further inward with respect to an extended line of the edge of the body of the antenna pattern, and an outward mounting mark of the tag LSI is formed between the extended line of the edge and the feeding point.

Additionally, the length of one side of the slit with respect to the feeding point may be formed to be longer than the length of the other side. Moreover, for example, a cutout may be formed in one side of the body of the antenna pattern.

An RFID tag in a second aspect of the present invention includes the tag patch antenna in the first aspect of the present invention, the tag LSI connected to the feeding point of the tag patch antenna, a resinous body molded in a shape of a card to hold the tag patch antenna and the tag LSI, a universal resinous substrate onto which the resinous body is pasted, and a conductor film pasted onto an outer surface that is a surface opposite to the surface pasted with the universal resinous substrate.

In this RFID tag, the conductor film may be, for example, an aluminum tape. Moreover, for example, a material having a relative permittivity $\in r$ of 3.5 and a dielectric loss tan $\delta$ of 0.01 may be available as the resinous body, and, for example, a material having a relative permittivity $\in r$ of 5.1 and a dielectric loss tan $\delta$ of 0.0003 may be available as the universal resinous substrate.

Furthermore, it is preferable that the resinous body is pasted onto the universal resinous substrate so that a surface opposite to a surface including external electrodes for the tag LSI is faced toward the surface onto which the resinous body is pasted.

Still further, one side of the body of the antenna pattern in the tag patch antenna may be short-circuited to the conductor film via a conductor.

Figure 1:
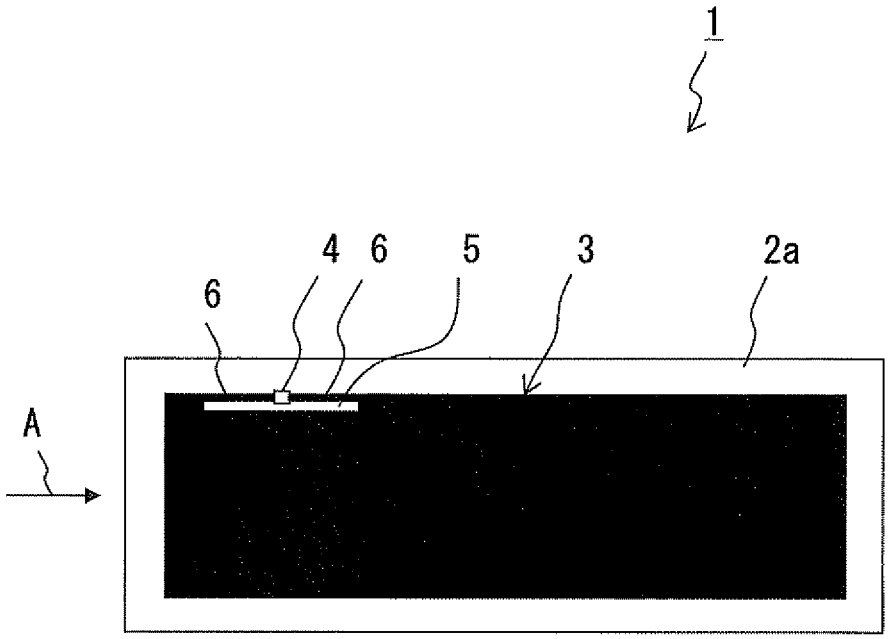
FIG. 1 is a top view of a tag patch antenna and an RFID tag using the tag patch antenna according to a first embodiment of the present invention.

| Explanation of Reference Numerals | |
|---|---|
| 1 | RFID tag |
| 2a | resinous substrate |
| 2b | resinous body |
| 3 | tag patch antenna (antenna pattern) |
| 4 | tag LSI |
| 5 | slit |
| 6 (6a, 6b) | part of an edge |
| 7 | universal resinous substrate |
| 8 | conductor film |
| 9 | adhesive |
| 10 | RFID tag |
| 11 | extended line of an edge |
| 12a, 12b | feeding portion |
| 13 | feeding point |
| 14 (14a, 14b) | mounting mark |
| 15 | dicing line |
| 16 | conductor |
| 17 | impedance of a tag patch antenna |

-continued

| Explanation of Reference Numerals | |
|---|---|
| 18 | impedance of a tag LSI |
| 19 | X axis of Smith chart |
| 20 | RFID tag |
| 21 | cutout portion |

DESCRIPTION OF EMBODIMENTS

First Embodiment

FIG. 1 is a top view of a tag patch antenna, and an RFID tag using the tag patch antenna according to a first embodiment of the present invention. FIG. 1 illustrates the basic form of a tag patch antenna according to the present invention.

As illustrated in FIG. 1, the RFID tag 1 according to this embodiment includes a resinous substrate 2*a*, a tag patch antenna 3 (hereinafter referred to also as an antenna pattern) formed on the resinous substrate 2*a*, and a tag LSI 4 connected to a feeding point of the tag patch antenna 3.

In the tag patch antenna 3 of the RFID tag 1, a slit 5 is formed in the vicinity of an edge (the edge of the upper side among the four sides in FIG. 1) along part of the edge (slightly over one quarter of the upper side in FIG. 1, in the left portion).

The feeding point is formed by cutting the intermediate portion of the part 6 of the edge that is separated by the slit 5 from the body of the antenna by the width of the slit 5, and the tag LSI 4 is connected to the feeding point.

The part 6 of the edge which is formed by the slit 5 operates as an inductance of the tag patch antenna 3, as will be described in detail later. The capacitance of the tag LSI 4 mounted at the feeding point is canceled out by this inductance.

Figure 2:
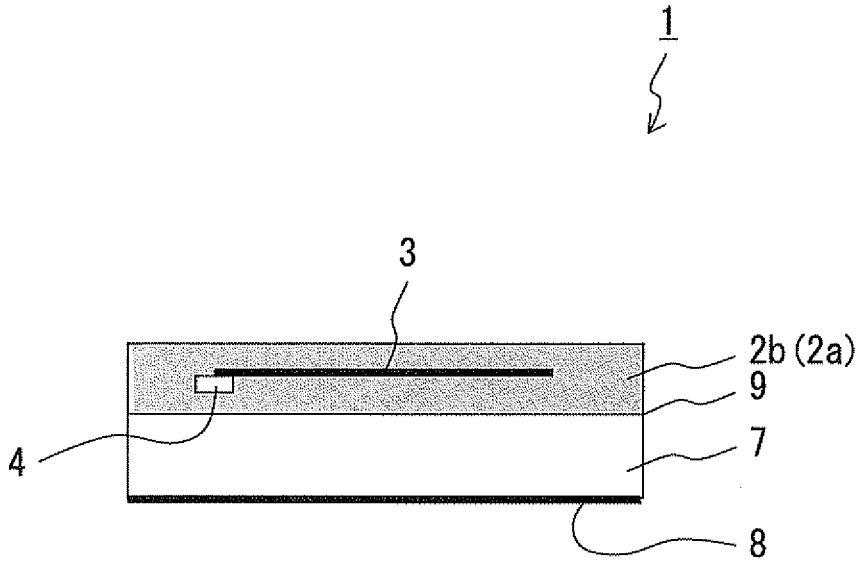
FIG. 2 is a side view of the RFID tag illustrated in FIG. 1 when viewed from the direction of arrow A illustrated in FIG. 1.

FIG. 2 is a side view of the RFID tag illustrated in FIG. 1 when viewed from the direction of arrow A illustrated in FIG. 1.

As illustrated in FIG. 2, the upper portion of the RFID tag 1 is configured with a resinous body 2*b* that is implemented by molding the tag patch antenna 3 and the tag LSI 4 connected to the feeding point of the tag patch antenna 3 in the shape of a card.

A method of molding the tag patch antenna 3 and the tag LSI 4 in the shape of a card using the resinous body 2*b* may be realized by a manufacturing manner similar to a normal inlet method for holding the resinous substrate 2*a* (on which the tag patch antenna 3 has been formed and the tag LSI 4 has been mounted at the feeding point) in a hollow within the die with a shape of a card, injecting a melted resinous body 2*b* into the die, and for cooling down the resinous body 2*b*.

The resinous body 2*b* is a dielectric resin, and the above described resinous substrate 2*a* is apparently integrated with the resinous body 2*b* to be visually indiscernible by being molded.

Additionally, a universal resinous substrate 7 is pasted onto the bottom of the resinous body 2*b* that is molded in the shape of a card as the upper portion. On an outer surface (the bottom surface in FIG. 2) of the universal resinous substrate 7, which is opposite to the pasted surface of the universal resinous substrate 7, a conductor film 8 is pasted.

The resinous body 2*b* and the universal resinous substrate 7 are pasted together with double-sided tape or an appropriate adhesive 9. For example, PET (polyethylene terephthalate) is used as the resinous body 2*b* and a universal material such as dielectric ABS (acrylonitrile-butadiene-styrene) resin, etc. is used as the universal resinous substrate 7.

Additionally, for example, adhesive aluminum tape or the like is used as the conductor film 8. The conductor film 8 forms a ground part for the tag patch antenna 3.

In this state, a resinous body 2*b* in the shape of a card is pasted onto the universal resinous substrate 7 so that a surface (the bottom surface in FIG. 2) opposite to a surface on which external electrodes of the tag LSI 4 are arranged (the top surface in FIG. 2) is oriented toward the pasted surface (direction of the adhesive 9) with the universal resinous substrate 7. As a result, the arrangement of the tag LSI 4 is structured to be highly resistant to shock or the like.

Second Embodiment

Figure 3:
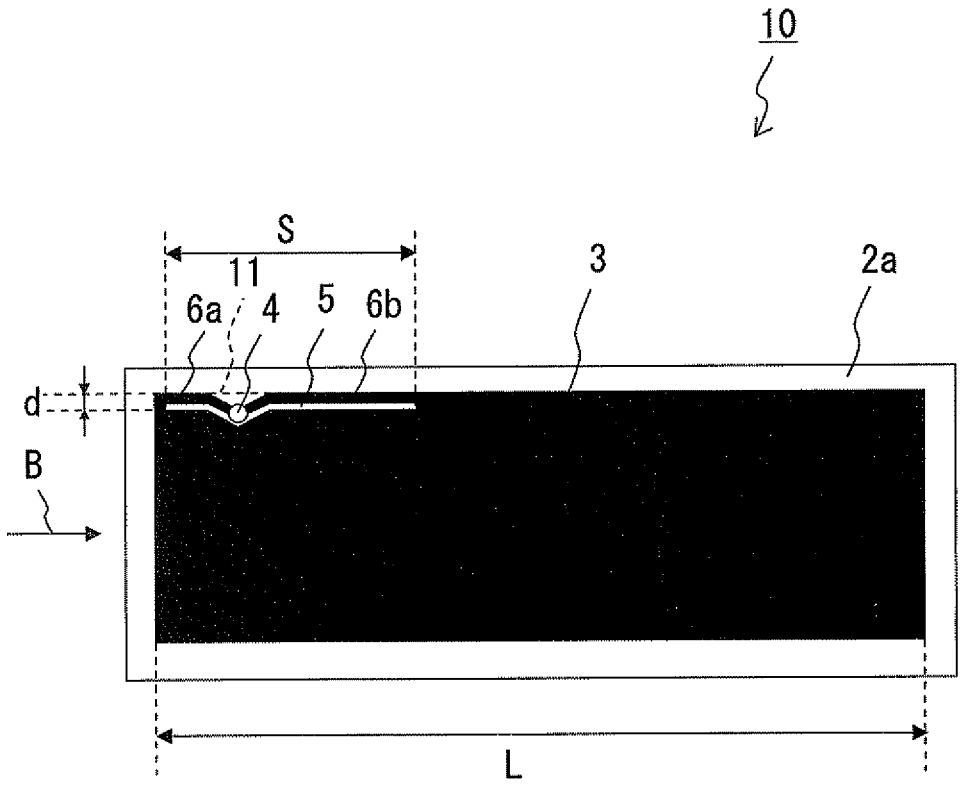
FIG. 3 is a top view of a tag patch antenna and an RFID tag using the tag patch antenna according to a second embodiment of the present invention.

FIG. 3 is a top view of a tag patch antenna and of an RFID tag using the tag patch antenna according to a second embodiment of the present invention.

Figure 4:
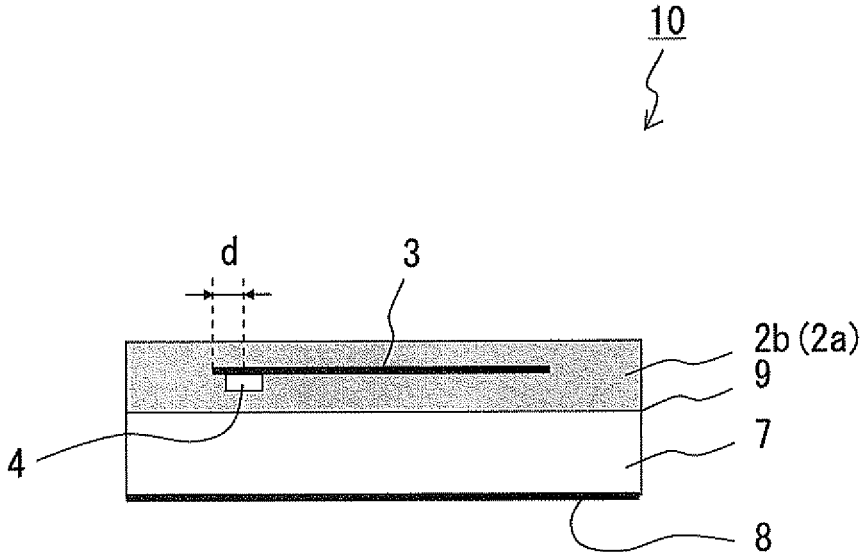
FIG. 4 is a side view of the RFID tag illustrated in FIG. 3 when viewed from the direction of arrow B illustrated in FIG. 3.

FIG. 4 is a side view of the RFID tag illustrated in FIG. 3 when viewed from the direction of arrow B illustrated in FIG. 3. In FIGS. 3 and 4, portions having the same configurations or functions as those in FIG. 1 or 2 are denoted with the same reference numerals as those in FIG. 1 or 2.

As illustrated in FIGS. 3 and 4, in the RFID tag 10 according to this embodiment, the shape of the slit 5, namely, the shape of part 6 (6*a*, 6*b*) of the edge, is different. That is, the intermediate portion of the part 6 of the edge is formed to be tilted toward the inner side of the body of the antenna pattern 3, along with the slit 5. In addition, the feeding point, namely, the position where the tag LSI 4 is mounted, is formed to be further inward with respect to an extended line 11 of the edge of the body of the antenna pattern 3 by a distance d (see also FIG. 4).

Furthermore, the length of one side (the right side in FIG. 3) of the slit 5 in this embodiment with respect to the feeding point, namely, the position where the tag LSI 14 is mounted, is formed to be longer than the length of the other side (the left side in FIG. 3). A relationship between the length S of the slit 5 and the length L of the antenna pattern 3 in FIG. 3 will be described in detail later.

Figure 5:
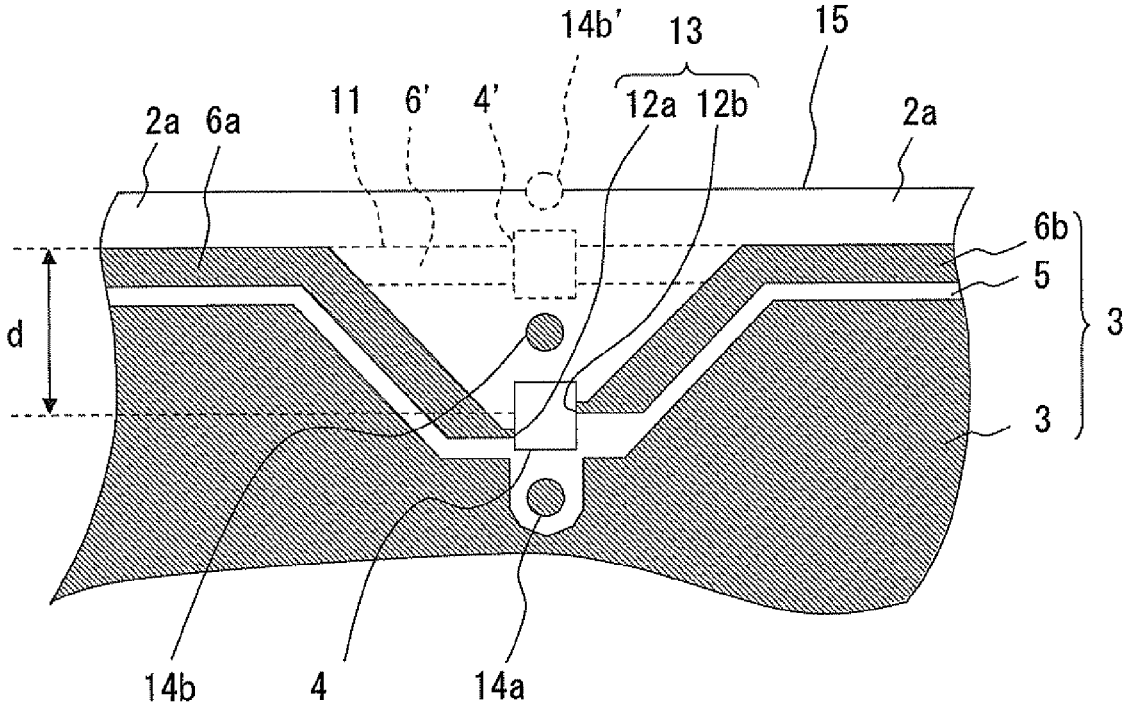
FIG. 5 is a schematic illustrating the details of a configuration of the vicinity of a feeding point of the tag patch antenna according to the second embodiment.

FIG. 5 is a schematic illustrating the details of the configuration of the vicinity of the feeding point illustrated in FIGS. 3 and 4.

Generally, a dedicated mounting machine is used to mount the tag LSI 4 in the antenna pattern 3 by mounting the tag LSI 4 at the feeding point 13 where the feeding portions 12*a* and 12*b* of the antenna pattern 3 are formed to be faced to each other, and by connecting two bumps, which are the external electrodes of the tag LSI 4 formed on the back surface, to the feeding portions 12*a* and 12*b*.

The dedicated mounting machine mounts the tag LSI 4 in the proper position of the feeding point 13 while recognizing as an image two mounting marks 14 (14*a*, 14*b*) that interpose the feeding point 13 and are formed in vicinities inward and outward from the feeding point 13, although this is not particularly illustrated.

Accordingly, it is necessary to form the mounting marks 14 (14*a*, 14*b*) in advance in positions inward and outward from the feeding point 13 in the antenna pattern 3.

Normally, the mounting marks 14 are formed with the same material as the tag patch antenna 3. Namely, the mounting marks 14 are designed to be included in the shape of the antenna pattern when the tag patch antenna 3 is formed on the resinous substrate 2*a*.

The outward mounting mark 14*b* among the mounting marks 14 (14*a*, 14*b*), which are formed in two positions inward and outward from the feeding point 13, is formed to be further inward with respect to the extended line 11 of the edge of the antenna pattern 2 between the extended line 11 of the edge and the feeding point 13. This is because the feeding point 13 is positioned to be further inward with respect to the extended line 11 of the edge of the antenna pattern 3 by the distance d as described above.

Here, if the antenna pattern 3 does not have a configuration where the feeding point 13 of the antenna pattern 3 is formed to be further inward with respect to the extended line 11 of the edge of the body of the antenna pattern 3 by the distance d, namely, if the antenna pattern 3 has a configuration represented with broken lines in FIG. 5, part 6' of the edge formed by the slit 5, and a tag LSI 4' mounted in a cutout portion, are arranged along the extended line 11 of the edge of the antenna pattern 3.

In this case, an outward mounting mark 14*b*' among the mounting marks 14 (14*a*, 14*b*), which are formed in two positions inward and outward from the feeding point 13, is arranged on the outer side of the tag LSI 4' with respect to the antenna pattern 3. Accordingly, the mounting mark 14*b*' is half-positioned in a dicing line 15 of the resinous substrate 2*a*, or is positioned completely on the outer side of the dicing line 15.

In either case, metal debris is generated along with the debris of the resinous substrate 2*a* after the resinous body 2*b* in the shape of a card is cut out along the dicing line 15 with a dicing line saw.

Additionally, if the mounting mark 14*b*' is half-positioned in the dicing line 15 of the resinous substrate 2*a*, the lifetime of the dicing line saw may be shortened because the mark 14*b*' portion is cut when the resinous body 2*b* in the shape of a card is cut out.

However, the entire antenna pattern 3 including the mounting marks 14 (14*a*, 14*b*) is accommodated within a predetermined area, namely, the area of the resinous body 2*b* in the shape of a card as in this embodiment, whereby metal debris is not generated when the resinous body 2*b* in the shape of a card is cut out along the dicing line 15 with the dicing line saw. Moreover, since the mounting marks 14 are not cut, the lifetime of the blade is not shortened.

Figure 6:
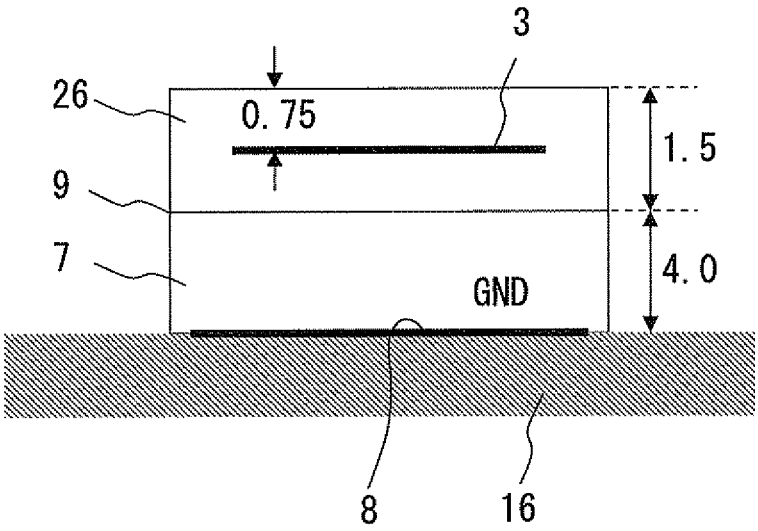
FIG. 6 is an explanatory view of a structure of layers of the RFID tag illustrated in FIG. 2 or 4.

FIG. 6 is an explanatory view of the structure of layers of the RFID tag 1 or 10 illustrated in FIG. 2 or 4. In FIG. 6, portions having the same configurations or functions as those illustrated in FIGS. 1 to 5 are denoted with the same reference numerals in FIGS. 1 to 5. Note that the tag LSI 4 is not illustrated.

As illustrated in FIG. 6, in the structure of layers of the RFID tag 1 or 10 according to the present invention, the resinous body 2*b* that is made of, for example, PET or the like, and is implemented by molding the antenna pattern 3, actually measures 1.5 mm, 3.5, and 0.01 respectively in thickness, permittivity $\in r$, and dielectric loss tan $\delta$.

In this shape, the antenna pattern 3 is formed at a depth of 0.75 from the top surface of the resinous body 2*b*.

Additionally, the universal resinous substrate 7 pasted onto the bottom surface of the resinous body 2*b* with the adhesive 9 measures 4.0 mm, 5.1, and 0.003 respectively in thickness, relative permittivity $\in r$, and dielectric loss tan $\delta$ in accordance with a merchandise catalog.

In the meantime, marketed ceramic substrates are as high as 20 to 30 in permittivity $\in r$, and also their prices are ten times the universal resinous substrate 7.

In the embodiment, the universal resinous substrate is used, whereby the RFID tag costs far less and can be mass-produced. In this configuration, the side of the conductor film 8 configured with aluminum tape, etc., is attached to the surface of a conductor 16 such as a metal, bottled water, a human body, etc., as illustrated in FIG. 6. As a result, an RFID tag in which the communication distance is not deteriorated is implemented.

Figure 7:
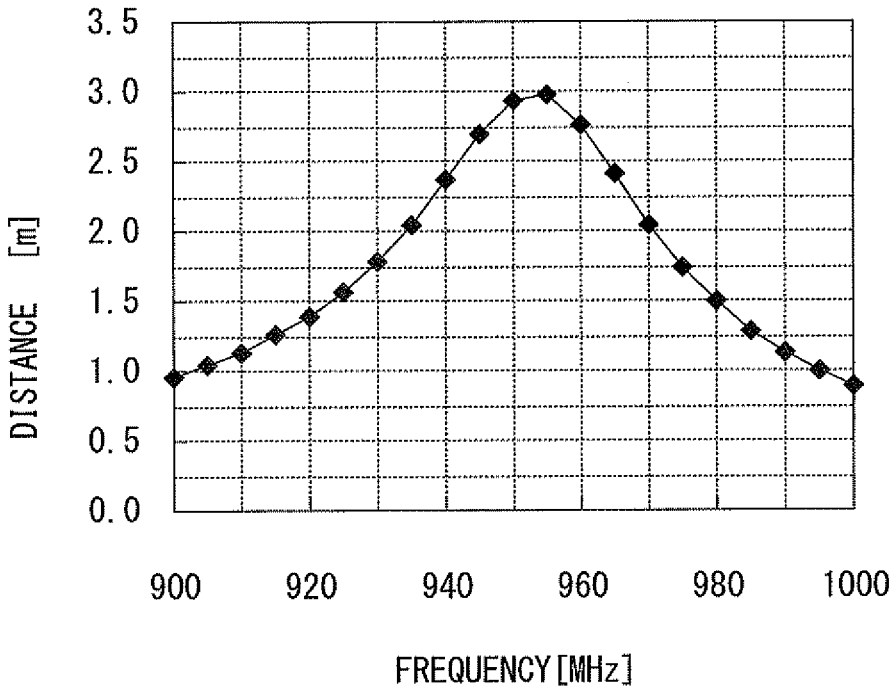
FIG. 7 is a characteristic chart illustrating results of simulating the communication distance of the RFID tag illustrated in FIG. 2 or 4 with a marketed electromagnetic-field simulator.

FIG. 7 is a characteristic chart illustrating results of calculating the communication distance of the above described RFID tags 1 and 10 with a three-dimensional electromagnetic-field simulator. The vicinities of the feeding points in the RFID tags 1 and 10 are different in shape. However, the same results are obtained if the lengths of the slits are identical.

In FIG. 7, the horizontal axis represents a frequency (MHz) ranging from 900 MHz to 1000 MHz (1 GHz), whereas the vertical axis represents a distance (m) ranging from 0.0 m to 3.5 m. The plot illustrated in this figure represents a communicable distance when the frequency is changed by 5 MHz.

As is known from the results of simulating the communication distance illustrated in FIG. 7, a practically sufficient communication distance of approximately 3 meters is obtained in the frequency band (952 MHz to 954 MHz) used in Japan. Thus the configuration of the RFID tag according to the present invention is effective.

Figure 8:
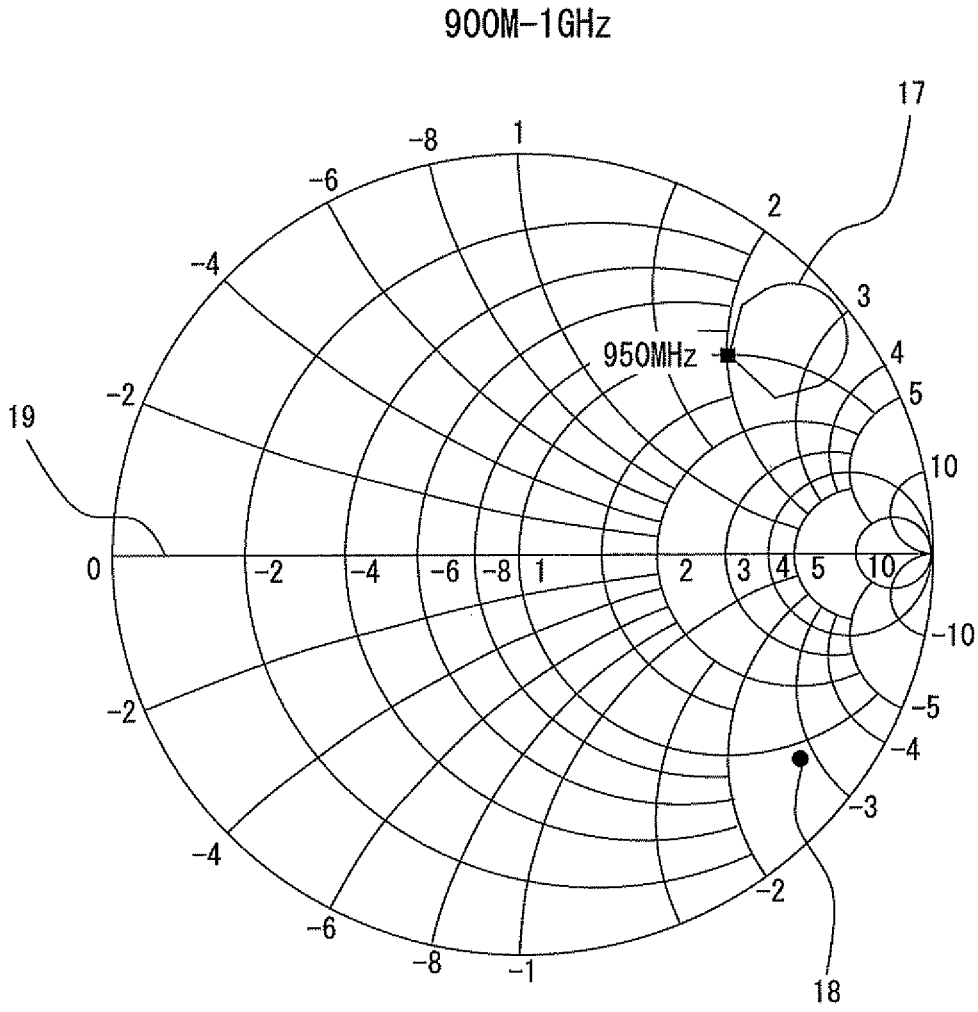
FIG. 8 is a chart illustrating results of simulating a relationship between the impedance of a tag LSI of the RFID tag and that of an antenna pattern in a frequency band ranging from 900 MHz to 1 GHz.

FIG. 8 is a chart illustrating results of simulating a relationship between the impedance of the tag LSI 4 of the RFID tag 1 or 10 and that of the antenna pattern 3 similarly with the three-dimensional electromagnetic-field simulator in a frequency band ranging from 900 MHz to 1000 MHz (1 GHz). In this simulation, 50Ω is represented as "1" as a reference.

As represented by the Smith chart of FIG. 8, the imaginary part of the impedance 17 of the antenna pattern 3 changes while drawing an approximate circle between +2 and +3.5, starting at 950 MHz. In the meantime, the impedance (approximately −30−j 110Ω in this embodiment) of the tag LSI 4 is positioned almost symmetrically with respect to the X axis 19.

Namely, the antenna pattern 3 and the tag LSI 4 match. Generally, the impedance of a tag antenna and that of a tag LSI have complex-conjugates of each other. Therefore, if both of the impedances are positioned symmetrically with respect to the X axis of the Smith chart as described above, the tag antenna can supply energy of electromagnetic wave to the tag LSI with high efficiency.

The following equations (1) and (2) represent the method of calculating the communication distance, which is used in the above described simulation.

$$r = \frac{\lambda}{4\pi}\sqrt{\frac{P_t G_t G_r q}{Pth}} \tag{1}$$

$$q = \frac{4R_c R_a}{|Z_c + Z_a|^2} \tag{2}$$

In the above provided equations (1) and (2), λ represents a wavelength, Pt represents the transmission power of RW (reader/writer), Gt represents an antenna gain (gain) of the RW, q represents a matching coefficient, Pth represents the minimum operation power of the tag LSI, Gr represents the gain of the tag antenna, Rc represents the resistance of the tag LSI, Xc represents the reactance of the tag LSI, Ra represents the resistance of the tag patch antenna, and Xa represents the reactance of the tag patch antenna.

Additionally, the calculation condition is that the minimum operation power Pth of the tag LSI is −9 dBm, the antenna gain Gt of the RW is 8 dBi, and the transmission power Pt of the RW is 26 dBm (cable loss is considered here). Moreover, Zc is defined to be equal to Rc+jXc, and Za is defined to be equal to Ra+jXa. Note that "j" represents an imaginary number.

Third Embodiment

In the configuration of the tag patch antenna 3 illustrated in FIG. 1 or 3 (see FIG. 3 hereinafter as a representative), the resonant frequency can be changed by varying the total length L of the antenna. In this case, the length S of the slit 5 is fixed, for example, to 23.5 mm, and the total length L is changed.

Figure 9:
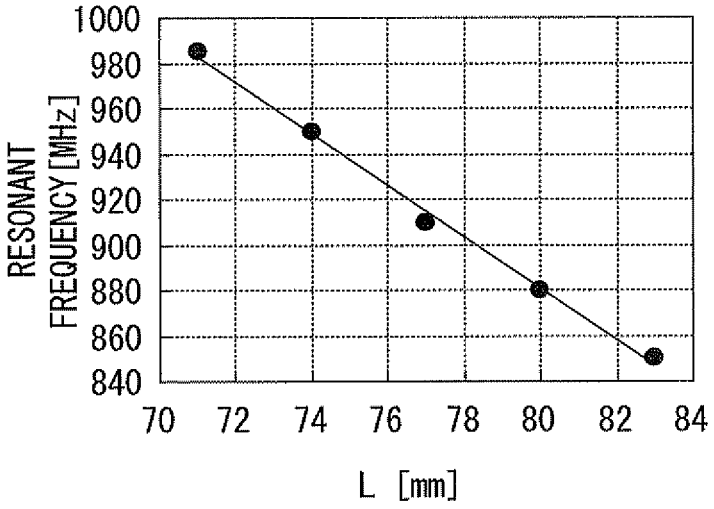
FIG. 9 is a characteristic chart illustrating a relationship between the total length L of the antenna and a resonant frequency when the length of the slit of the antenna pattern of the RFID tag as a third embodiment is set to a fixed length and the total length L is changed.

FIG. 9 is a characteristic chart illustrating a relationship between the total length L of the antenna and the resonant frequency when the length S of the slit 5 is fixed to 23.5 mm and the total length L is changed.

In the characteristic chart illustrated in FIG. 9, the horizontal axis represents the total length L (mm) of the tag patch antenna 3 ranging from 70 mm to 84 mm, whereas the vertical axis represents the resonant frequency (MHz) ranging from 840 MHz to 1000 MHz.

As illustrated in FIG. 9, the resonant frequency (MHz) linearly changes with respect to the total length L (mm) of the tag patch antenna 3. Moreover, it is represented that the total length L (mm) of the tag patch antenna 30, which is adaptable to the frequency band (952 MHz to 954 MHz) used in Japan, is 74 mm.

It is also represented, from FIG. 9, that the total length L (mm) of the tag patch antenna 3 is adaptable to the 865 MHz used in the EU by being set to approximately 81.5 mm. It is further represented, from FIG. 9, that the total length L (mm) of the tag patch antenna 3 is adaptable to the 915 MHz used in the US by being set to approximately 76.5 mm.

As illustrated in FIG. 9, the resonant frequency linearly changes from approximately 990 MHz to 850 MHz with respect to a change in the total length L (mm) of the tag patch antenna 3 from 71 mm to 83 mm.

As described above, the tag patch antenna 3 according to the present invention is adaptable to a broad band only by changing the total length L of the antenna.

Fourth Embodiment

The value of the capacitance within the tag LSI 4 varies depending on the manufacturer or part number. The tag patch antenna 3 according to the present invention is not only adaptable to a broad band but is also able to easily adjust matching with the tag LSI 4 by causing an alternating current circuit, formed in the shape of a loop by the part 6 of the edge formed by the slit 5 and the body of the antenna, to work as an inductance. This is described below.

Figure 10:
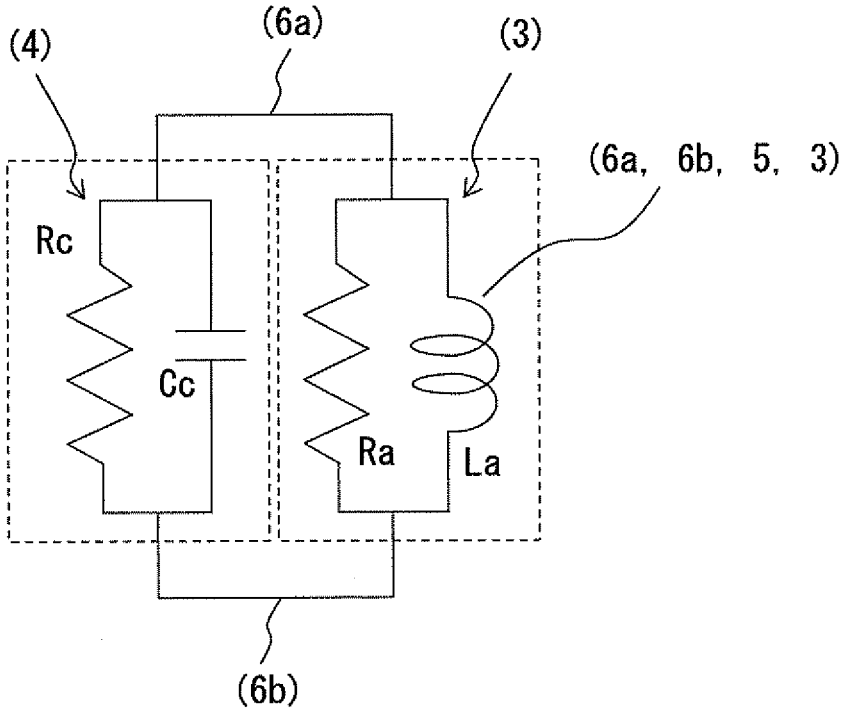
FIG. 10 is a circuit diagram illustrating an equivalent circuit of the tag LSI and the tag patch antenna of the RFID tag.

FIG. 10 is a circuit diagram illustrating an equivalent circuit of the tag LSI 4 and the tag patch antenna 3 of the above described RFID tags 1 and 10 (described hereinafter with reference to the RFID tag 10 of FIG. 3 as a representative). In this figure, circuit portions corresponding to the configuration of FIG. 3 are denoted with the numerals of FIG. 3 in parentheses.

Not only the tag LSI 4 according to this embodiment but also LSI chips generally include a parallel resistance Rc (approximately 200 to 2000Ω) and a parallel capacitance Cc (approximately 0.2 to 2 pF).

In the meantime, the equation "$f0=\frac{1}{2\pi\sqrt{LC}}$" for calculating the condition under which the above described LSI chip and an antenna having an inductance match at a certain resonant frequency f0 is well known.

Here, to cause the RFID tag 10 and the tag patch antenna 3, which are illustrated in FIG. 3, to match, it is known that, preferably, the parallel inductance La of the tag patch antenna 3 and the parallel capacitance Cc of the tag LSI 4 cancel each other out if the parallel resistance Ra of the tag patch antenna 3 illustrated in FIG. 10 has the same value as the parallel resistance Rc of the tag LSI 4, and the parallel inductance La of the tag patch antenna 3 has the relationship represented by the above provided equation.

If the parallel inductance La of the tag patch antenna 3 and the parallel capacitance Cc of the tag LSI 4 cancel each other out as described above, all power induced by electromagnetic waves received by the tag patch antenna 3 is supplied to the tag LSI 4. Moreover, all power from the tag LSI 4 is supplied to the tag patch antenna 3, and is externally emitted.

Therefore, a match with the parallel capacitance Cc of the tag LSI 4 is observed by varying the parallel inductance La of the tag patch antenna 3.

Figure 11:
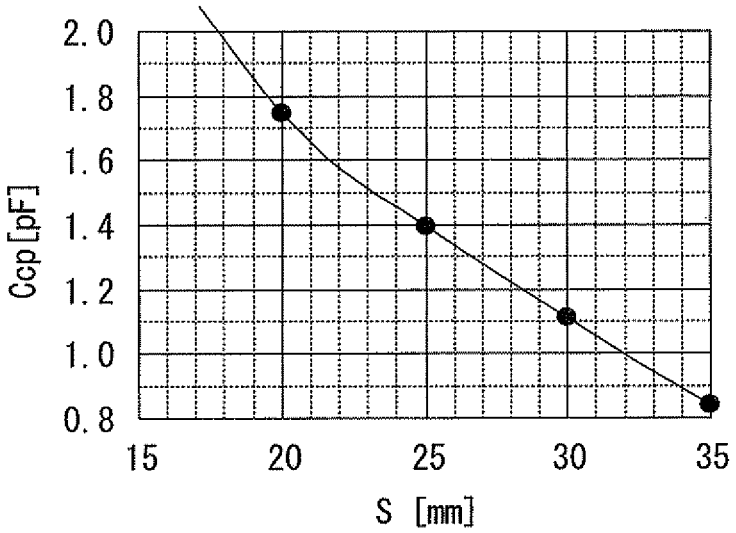
FIG. 11 is a characteristic chart illustrating a relationship between the length S of the slit and the capacitance Cc of the tag LSI when the total length of the antenna pattern of the RFID tag as a fourth embodiment is set to a fixed length and the length S is changed.

FIG. 11 is a characteristic chart illustrating a relationship between the length S of the slit 5 and the capacitance Cc of the tag LSI 4, which matches with the tag patch antenna 3, when the total length L of the tag patch antenna 3 illustrated in FIG. 3 is fixed to 73.0 mm and the length S is varied.

In FIG. 11, the horizontal axis represents the length S (mm) of the slit 5 ranging from 15 mm to 35 mm, whereas the vertical axis represents the capacitance Cc (pF) of the tag LSI 4 ranging from 0.8 pF to 2.0 pF.

Additionally, this figure represents a characteristic curve obtained by plotting values resulting from simulating a model where the length S (mm) of the slit 5 is lengthened from 20 mm to 35 mm in increments of 5 mm.

As illustrated in FIG. 11, in the RFID tag 10 according to the present invention illustrated in FIG. 3, it is represented that the tag patch antenna 3 is caused to match the tag LSI 4 having any capacitance in the range from 2.0 pF to 0.85 pF by varying the length S (mm) of the slit 5 from 17.5 mm to 35 mm when the total length L of the tag patch antenna 3 is fixed to 73.0 mm.

Fifth Embodiment

The method of adjusting a resonant frequency at which the tag patch antenna 3 and the tag LSI 4, which are referred to in the third embodiment, match is not limited to the method of changing the total length of the tag patch antenna.

Figure 12:
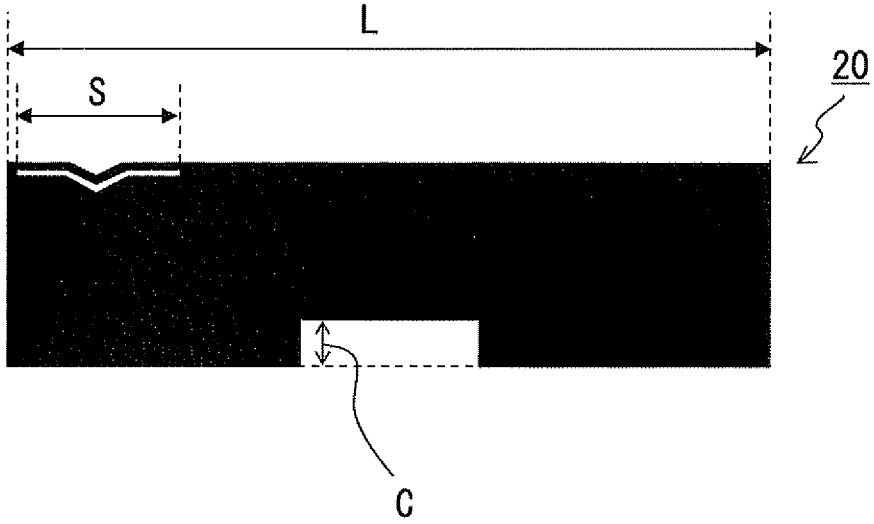
FIG. 12 is a schematic illustrating the shape of a tag patch antenna that adjusts a resonant frequency for matching with the tag LSI while the total length of the tag patch antenna according to a fifth embodiment is held fixed.

FIG. 12 is a schematic illustrating the shape of a tag patch antenna that adjusts the resonant frequency for matching with the tag LSI while the total length of the tag patch antenna according to a fifth embodiment is held fixed.

As illustrated in FIG. 12, in the tag patch antenna 20 according to this embodiment, a cutout 21 is formed on the side of an edge opposite to the edge on which the slit 5 of the tag patch antenna 3 illustrated in FIG. 3 is formed.

It was proven from the results of a simulation and experiments that the resonant frequency is adjusted by changing the depth C of the cutout 21.

Namely, operations and effects similar to those obtained by increasing the total length L of the tag patch antenna is achieved by changing the depth C of the cutout 21 while the total length L of the tag patch antenna is held fixed.

In any of the above described embodiments, the total length of the tag patch antenna can be halved by short-circuiting one side of the tag patch antenna to the conductor film of the ground part via an appropriate conductor, although this is not particularly illustrated.

In this case, although an effective bandwidth becomes narrow, other performance capabilities are similar to those of the above described embodiments.

As described above in detail, according to the present invention, an RFID tag without a deteriorated communication distance despite being attached to an object including a liquid or a metal can be provided.

Additionally, a tag patch antenna that can easily adjust a match with a tag LSI can be provided by setting the impedance of the tag LSI to "several tens+j several hundreds of Ω" (j is an imaginary number).

Furthermore, an expensive material such as a high-frequency substrate, etc. is not used but rather a marketed PET resin or a universal resinous substrate is used as a dielectric. Therefore, the RFID tag can be simplified in structure and mass-produced at low cost, thereby readily meeting the growing demand of the market expected in the future.

Still further, there is no need to make the front and the back surfaces of a tag continuous by making a penetration hole in a dielectric substrate when the front and the back surfaces of the tag are connected as in a normal patch antenna. As a result, the RFID tag can be manufactured with simple process steps.

What is claimed is:

1. A tag patch antenna, comprising:

a slit formed in a vicinity of an edge of an antenna pattern along a part of the edge; and a feeding point to which a tag LSI is connected and which is formed by cutting an intermediate portion of the part of the edge separated by the slit from a body of the antenna pattern by a width of the slit, wherein the intermediate portion of the part of the edge is formed to be tilted toward an inner side of the body of the antenna pattern along with the slit, the feeding point is formed to be further inward with respect to an extended line of the edge of the body of the antenna pattern, and an outward mounting mark of the tag LSI is formed between the extended line of the edge and the feeding point.

2. The tag patch antenna according to claim 1, wherein a length of one side of the slit with respect to the feeding point is formed to be longer than a length of the other side.

3. The tag patch antenna according to claim 1, wherein a cutout is formed in one side of the body of the antenna pattern.

4. An RFID tag, comprising:

the tag patch antenna according to claim 1;

the tag LSI connected to the feeding point of the tag patch antenna;

a resinous body molded in a shape of a card to hold the tag patch antenna and the tag LSI;

a universal resinous substrate onto which the resinous body is pasted; and a conductor film pasted onto an outer surface that is a surface opposite to the surface pasted with the universal resinous substrate.

5. The RFID tag according to claim 4, wherein the conductor film is an aluminum tape.

6. The RFID tag according to claim 4, wherein a relative permittivity $\in r$ and a dielectric loss tan $\delta$ of the resinous body are 3.5 and 0.01, respectively.

7. The RFID tag according to claim 4, wherein a permittivity $\in r$ and a dielectric loss tan $\delta$ of the universal resinous substrate are 5.1 and 0.0003, respectively.

8. The RFID tag according to claim 4, wherein the resinous body is pasted onto the universal resinous substrate so that a surface opposite to a surface including external electrodes for the tag LSI is faced toward the surface onto which the resinous body is pasted.

9. The RFID tag according to claim 4, wherein one side of the body of the antenna pattern of the tag patch antenna is short-circuited to the conductor film via a conductor.

* * * * *